US005092152A

United States Patent [19]

Miller et al.

[11] Patent Number: 5,092,152

[45] Date of Patent: Mar. 3, 1992

[54] CRIMPING MACHINE

[75] Inventors: William P. Miller, Willowick; Michael D. Cawley, Cleveland, both of Ohio

[73] Assignee: Parker-Hannifin Corporation, Cleveland, Ohio

[21] Appl. No.: 589,249

[22] Filed: Sep. 28, 1990

[51] Int. Cl.[5] ..... B21D 41/04

[52] U.S. Cl. ..... 72/402; 72/452; 29/237

[58] Field of Search ..... 72/402, 452, 416; 29/237

[56] References Cited

U.S. PATENT DOCUMENTS

| | | | |
|---|---|---|---|
| 3,455,140 | 7/1969 | Galan | 72/416 |
| 3,731,518 | 5/1973 | Blocher | 72/402 |
| 4,339,940 | 7/1982 | MacKay | 72/402 |
| 4,785,656 | 11/1988 | Kennedy | 72/402 |
| 4,854,031 | 8/1989 | Eisenzimmer | 72/402 |
| 4,989,443 | 2/1991 | Sawdon | 72/402 |

*Primary Examiner*—Daniel C. Crane
*Attorney, Agent, or Firm*—James A. Baker

[57] ABSTRACT

An improved crimping machine for crimping fittings on high pressure flexible hose of the type having a pair of opposed anvils moveable between an uncrimp position and a crimp position. A split crimp cage with each half thereof attached to respective ones of the anvils is provided. The crimp cage retains a plurality of crimping dies axially slideable within corresponding cage slots that are arranged in a uniform circular pattern about the cage. The cage slots extend radially from a common central transverse axis. The improvement comprises the use of crimping dies having substantially the same radial length, and substantially flat anvil cam surfaces that actuate the crimping dies to move at a uniform rate during a crimping operation. To achieve the uniform rate of travel, the flat anvil cam surfaces are oriented at a predetermined angle relative to the corresponding crimping die radial axis.

3 Claims, 1 Drawing Sheet

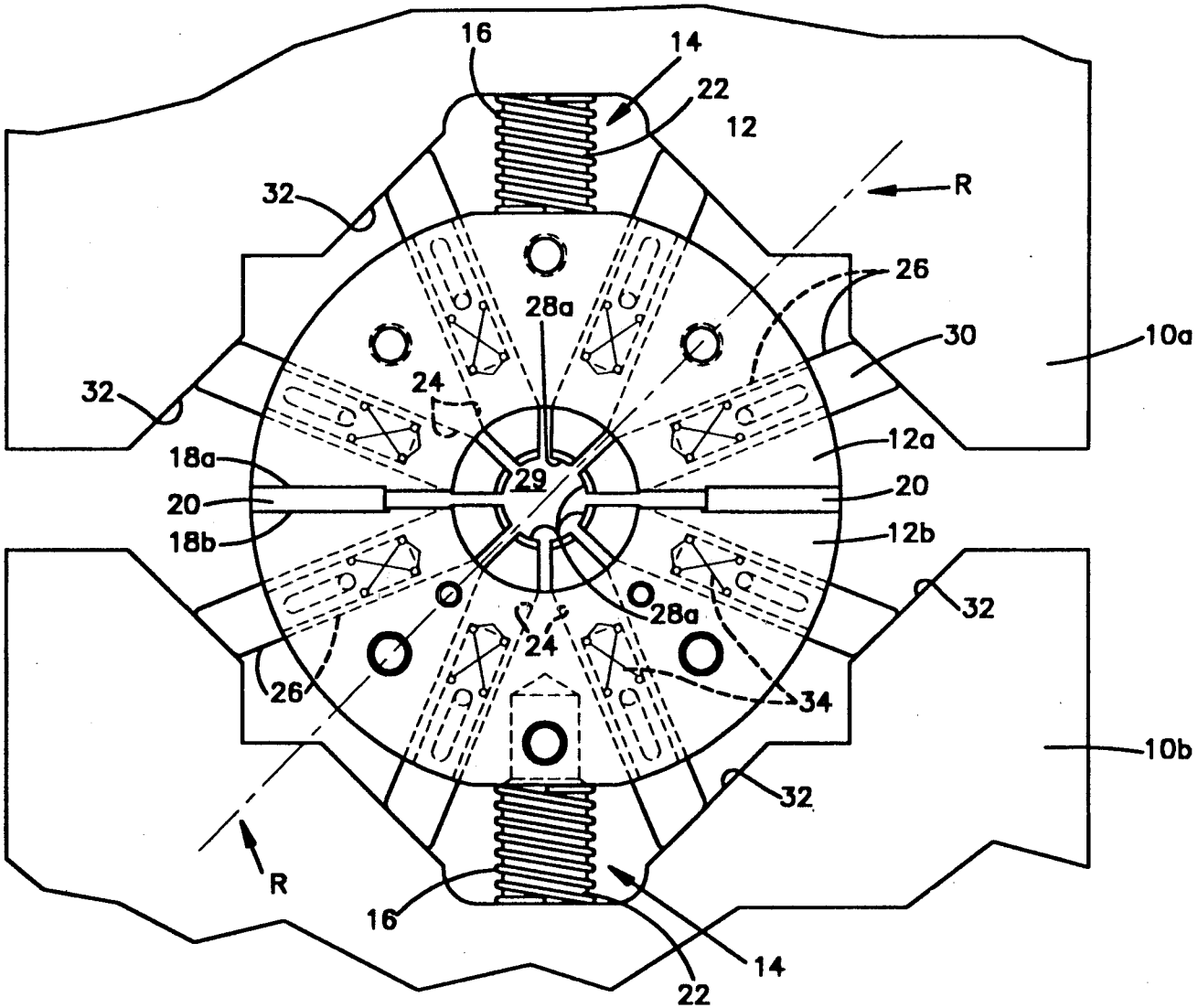
10a
10b
R
R
26
26
30
12a
20
12b
32
32
32
32
34
12
22
14
14
22
28a
28a
29
24
24
16
16
18a
20
18b

CRIMPING MACHINE

BACKGROUND OF THE INVENTION

The invention relates generally to machines used to crimp fittings on flexible high-pressure hose and the like. More specifically, the invention relates to crimping machines that use a split crimp cage and anvil which, when brought together, actuate a plurality of crimping dies to a predetermined crimp diameter on the fitting.

Split crimping machines for crimping fittings on flexible hose assemblies are well known. A typical example of such a crimper is disclosed in U.S. Pat. No. 3,731,518 issued to Blocher. Split crimpers have an advantage over radial crimpers in that odd-shaped hose assemblies can still be crimped whereas radial crimpers permit only axial assemblies (end to end) to be crimped.

A significant disadvantage, however, of the Blocher type crimper is that the crimp is only concentric at the final desired crimp diameter. At points of overcrimp and undercrimp the fitting is not concentrically formed. This feature severely limits the useful degree of overcrimping. Previous split crimpers also used crimping dies of variant length resulting in greater complexity and increased manufacturing cost.

SUMMARY OF THE INVENTION

The present invention overcomes the aforementioned drawbacks of prior split crimping machines by providing a split crimper that achieves a concentric crimp at the desired crimp diameter and throughout the crimp operation at undercrimp and overcrimp positions. This is achieved by a crimper design that achieves uniform rates of travel for the crimping dies during a crimping operation. The present invention also contemplates a crimper design in which all the crimping dies are substantially the same length.

Such a crimping machine, according to one aspect of the invention, includes a pair of anvils one or both of which can be moved toward the other to a crimp position and back to an uncrimp position. A split crimp cage is provided, each half of which is mounted on a respective one of the anvils for movement therewith. The cage members are spring mounted on their respective anvils to also permit relative movement therewith. The crimp cage includes a plurality of crimping die slots each of which is adapted to slideably retain a crimping die. The crimping dies are arranged in the cage in a generally circular pattern with each die lying along a radial line from a common transverse axis.

According to another aspect of the invention, the crimping dies are actuated by movement of one or both of the anvils to the crimp position such that the crimp diameter is concentric during the entire crimping cycle. Concentricity is maintained by assuring that all the crimping dies travel at a uniform rate as the anvils and crimp cage move toward the crimp position.

Another aspect of the invention provides that the anvils have substantially flat cam surfaces in contact with respective ends of the crimping dies. The anvil cam surfaces are disposed at an angle perpendicular to a radial line which bisects adjacent pairs of crimping dies.

Still another aspect of the invention is a crimping machine in which all of the crimping dies are substantially the same radial length.

These and other aspects and advantages of the present invention are more fully set forth in the following specification in view of the accompanying drawing.

DESCRIPTION OF THE DRAWING

The drawing is a partial elevation of a crimping machine according to the present invention as it would generally appear in a crimp position.

DESCRIPTION OF PREFERRED EMBODIMENTS

With reference to the drawing, a split crimping machine according to the present invention for crimping fittings on to high pressure hoses and the like includes a pair of anvils 10*a* and 10*b* (partially shown) which may be conveniently connected to an actuating device (not shown) such as a pneumatic or hydraulic ram or other suitable device. The particular actuating device selected is a matter of design choice and forms no part of the present invention. See, for example, U.S. Pat. No. 3,731,518 which is fully incorporated herein by reference.

A split crimp cage 12 is provided with one-half of the cage 12*a* attached to the anvil 10*a*, and the other half of the cage 12*b* attached to the opposing anvil 10*b*. Each cage member 12*a,b* is substantially semicircular in plan such that when the cage halves are forced together by the anvils to a crimp position the cage members generally form a completely circular cage enclosure 12.

The cage members 12*a,b* are preferably mounted to the respective anvils 10*a,b* with a slip rod and spring assembly 14 such that in the uncrimp position (not shown) the spring 16 holds the cage 12 and anvil 10 apart a predetermined distance. When the anvils 10*a,b* are forced towards each other the cage halves 12*a,b* also travel therewith until their opposing faces 18*a,b* touch. Spacers 20 may be provided to maintain a limited separation between the cage halves so that a circular cage can be formed from two cage halves split from a single body. The slip rods 22 permit the anvils 10*a,b* to continue traveling towards each other to the crimp position after the cage members have mated up.

The cage elements 12*a,b* include radial slots 24 therethrough arranged in a generally circular pattern about a common transverse axis. As viewed in the drawing, the transverse axis passes through the center of the cage perpendicular to the drawing and generally defines the alignment axis for a fitting and hose assembly. One of the advantages of a split crimper is that the fitting and hose assembly can be aligned from the side rather than having to be inserted axially into the crimp area 29.

Each slot 24 slideable retains a crimping die 26. Each die 26 has an inner crimping end 28 with face portion 28*a* patterned to provide a desired crimp form in a conventional manner. The inner terminal crimp ends 28 of the dies 26 define a crimping area or region 29 in which the fitting and hose to be crimped are positioned when the crimper is in the uncrimp position i.e. when the anvils 10 and crimp cage members 12*a,b* are separated.

Each die 26 also has an end 30 opposite its respective crimping end 28 that extends beyond the outer perimeter of the cage member. Each opposite die end 30 engages a flat cam portion or surface 32 of the anvils. The die ends 30 are urged against the anvil surface 32 by captured springs 34 within the cage slots 24. The opposite die ends 30 are each chamfered at an appropriate angle to rest flat against the respective anvil cam surface 32.

In the preferred exemplary embodiment shown in the drawing, there are eight crimping dies uniformly spaced about the crimp area 29, or at about 45° between adjacent dies. Each of the eight crimping dies also has substantially the same radial length. For convenience, the eight dies are grouped into four adjacent pairs of dies such that certain adjacent pairs share a common coplanar anvil cam surface. Each anvil cam surface 32 is oriented perpendicular to a radial line (labelled "R" in the drawing) that bisects the adjacent pair of crimping dies that share that respective anvil cam surface. Additionally, each crimping die in each of the cage halves 12*a* and 12*b* is radially opposite another of the crimping dies on the other cage half. The opposite die end 30 of each crimping die 26 has a substantially flat cam portion which engages an associated anvil cam surface 32. The substantially flat cam portions on the opposite ends 30 of the crimping dies 26 and the associated anvil cam portions 31 are all arranged at a predetermined angle relative to the corresponding crimping die radial axis. The predetermined angles of all radially opposite crimping dies are identical, and the predetermined angles of all circumferentially adjacent crimping dies are complementary.

By utilizing these features, as the anvils 12*a,b* are forced toward each other the crimping dies will all travel towards the center crimp area 29 at the same rate, thus maintaining concentricity at each point during a crimp cycle. This has a particular advantage in permitting the crimper to substantially overcrimp without distorting the desired uniform shape of the fitting. Furthermore, since all the crimping dies have substantially the same dimensions the manufacture and use of the crimper are simplified since the dies are interchangeable. The final crimp diameter, of course, can be easily adjusted by selecting the appropriate radial length of the dies.

The drawing is only one example of a crimper according to the present invention, and should not be viewed in a limited way to a certain number of dies or angle of orientation. Using symmetrical orientation of the dies is preferred as it greatly simplifies the design of the crimper. By using dies of substantially the same radial length acting against a flat cam surface, the orientation of the cam surface can be selected relative to the corresponding crimping die radial axis on which it exerts force to provide uniform rates of travel of the dies.

While the invention has been shown and described with respect to a particular embodiment, thereof, this is for the purposes of illustration rather than limitation, and other variations and modifications of the specific embodiments herein shown and described will be apparent to those skilled in the art within the intended spirit and scope of the claimed invention.

What is claimed is:

1. An improved machine for crimping a fitting onto a flexible hose of the type having a pair of opposed anvils selectively movable between an uncrimp position and a crimp position and back to said uncrimp position, a split crimp edge with each half thereof attached to respective ones of said anvils for movement therewith, each of said cage halves including a plurality of crimping dies axially slidable within corresponding cage slots, said crimping dies being arranged in a uniform circular pattern with each die extending along a radial axis from a common transverse axis and with each of said crimping dies in each of said cage halves being radially opposite another of said crimping dies in the other of said cage halves, each of said crimping dies having a first end configured to provide a desired crimp pattern and an opposite second end extending beyond said cage for slidable contact with said anvil, the improvement comprising all of said crimping dies having substantially the same radial length and having a substantially flat cam portion on said opposite second end, said anvils having a substantially flat cam portion in contact with said substantially flat cam portion of all of said crimping dies throughout an entire crimp operation, all of said cam portions being disposed at a predetermined angle relative to the corresponding crimping die radial axis, said predetermined angle of all radially opposite crimping dies being identical, and said predetermined angles of all circumferentially adjacent crimping dies being complementary to one another, so that the crimping dies move under force from the anvils at a substantially uniform rate and maintain a concentric crimp throughout an entire crimping operation.

2. The improved crimping machine according to claim 1 wherein circumferentially adjacent crimping dies having complementarily predetermined angles each contact flat coplanar anvil cam portions.

3. The improved crimping machine according to claim 2 wherein each of said coplanar cam portions is oriented at an angle perpendicular to a radial line which bisects said respective adjacent pair of crimping dies.

* * * * *

UNITED STATES PATENT AND TRADEMARK OFFICE

CERTIFICATE OF CORRECTION

PATENT NO. : 5,092,152

DATED : March 3, 1992

INVENTOR(S) : William P. Miller and Michael D. Cawley

It is certified that error appears in the above-identified patent and that said Letters Patent is hereby corrected as shown below:

Claim No. 1, column 4, line 13, the word "edge" should be "cage".

Signed and Sealed this

Fourth Day of May, 1993

*Attest:*

*Attesting Officer*

Michael K. Kirk

MICHAEL K. KIRK

*Acting Commissioner of Patents and Trademarks*